US006053372A

United States Patent [19]

Abedi

[11] Patent Number: 6,053,372

[45] Date of Patent: Apr. 25, 2000

[54] PUMP ACTIVATED FLUID DISPENSER

[76] Inventor: Homayoun Abedi, 22644 Burton St., West Hills, Calif. 91304

[21] Appl. No.: 09/268,534

[22] Filed: Mar. 12, 1999

[51] Int. Cl.[7] ..... B67D 5/40

[52] U.S. Cl. ..... 222/383.1; 222/402

[58] Field of Search ..... 222/383.1, 401, 222/402

[56] References Cited

U.S. PATENT DOCUMENTS

| | | | |
|---|---|---|---|
| 4,216,882 | 8/1980 | Basile et al. | 222/207 |
| 4,220,285 | 9/1980 | Gualdi | 222/383.1 |
| 4,260,079 | 4/1981 | Cary et al. | 222/209 |
| 4,537,334 | 8/1985 | Spengler et al. | 222/401 |
| 5,197,638 | 3/1993 | Wood | 222/212 |
| 5,273,191 | 12/1993 | Meshberg | 222/105 |
| 5,460,300 | 10/1995 | Tristch | 222/402 |
| 5,816,503 | 10/1998 | Nelson | 222/383.1 |
| 5,839,621 | 9/1980 | Tada | 222/383.1 |

FOREIGN PATENT DOCUMENTS

| | | | |
|---|---|---|---|
| 0338844 | 10/1989 | European Pat. Off. | 222/401 |

*Primary Examiner*—Joseph A. Kaufman
*Attorney, Agent, or Firm*—Goldstein & Canino

[57] ABSTRACT

A pump actuated fluid dispenser for selectively dispensing a sporadic or continuous supply of fluid from within a container interior. The fluid dispenser comprises a main body mounted on a cap, a plunger shaft within the main body, and a trigger mounted to the main body and the plunger. A pumping cylinder extends downward from the cap, and houses a hollow tube that extends downward from the main body, such that the bottom of the tube allows fluids to pass therethrough from within the container interior and into the interior of the plunger shaft. A washer is mounted on the hollow tube that moves upward and downward within the interior of the cylinder. The cylinder has a one-way valve, which allows passage of air from within the cylinder to the container when the washer moves upward.

9 Claims, 2 Drawing Sheets

PUMP ACTIVATED FLUID DISPENSER

BACKGROUND OF THE INVENTION

The invention relates to a fluid dispenser. More particularly, the invention relates to a pump actuated fluid dispenser that may be used to dispense fluids for extended periods.

There are several different techniques for dispensing liquids from a container. One technique is to provide a resilient dispensing bottle with an outlet orifice such that when the bottle is squeezed by a user, pressure builds up within it. The pressure in the bottle forces liquid out through the outlet orifice.

Another technique is to use a trigger operated fluid dispenser, where squeezing the trigger causes water to flow out of the container. An example of such a device is provided in U.S. Pat. No. 4,260,079 to Cary et al., which discloses a manually operated dispensing device having a variable volume pump. Another patent, U.S. Pat. No. 4,216,882 to Basile et al. discloses a manually actuable fluid dispenser having a flexible bellows which is operable by a reciprocal trigger member.

While the units mentioned above may be suitable for the particular purpose employed, or for general use, they would not be as suitable for the purposes of the present invention as disclosed hereafter.

SUMMARY OF THE INVENTION

It is an object of the invention to provide a device that dispenses liquid from a container in a mist.

It is another object of the present invention to disclose a fluid dispenser that is capable of dispersing fluid for an extended period.

It is a further object of the present invention to provide a fluid dispenser that selectively provides either a sporadic or continuous fluid spray from within a container. Accordingly, herein is disclosed a pump actuated fluid dispenser that couples a spray mechanism with a pump mechanism, which allows the user to selectively dispense liquids for a brief period or for a longer period from within a container.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

The above and other aspects, features and advantages of the present invention will be more apparent from the following detailed description thereof, which is presented in conjunction with the following drawing.

DETAILED DESCRIPTION OF THE PREFERRED EMBODIMENTS

Figure 1:
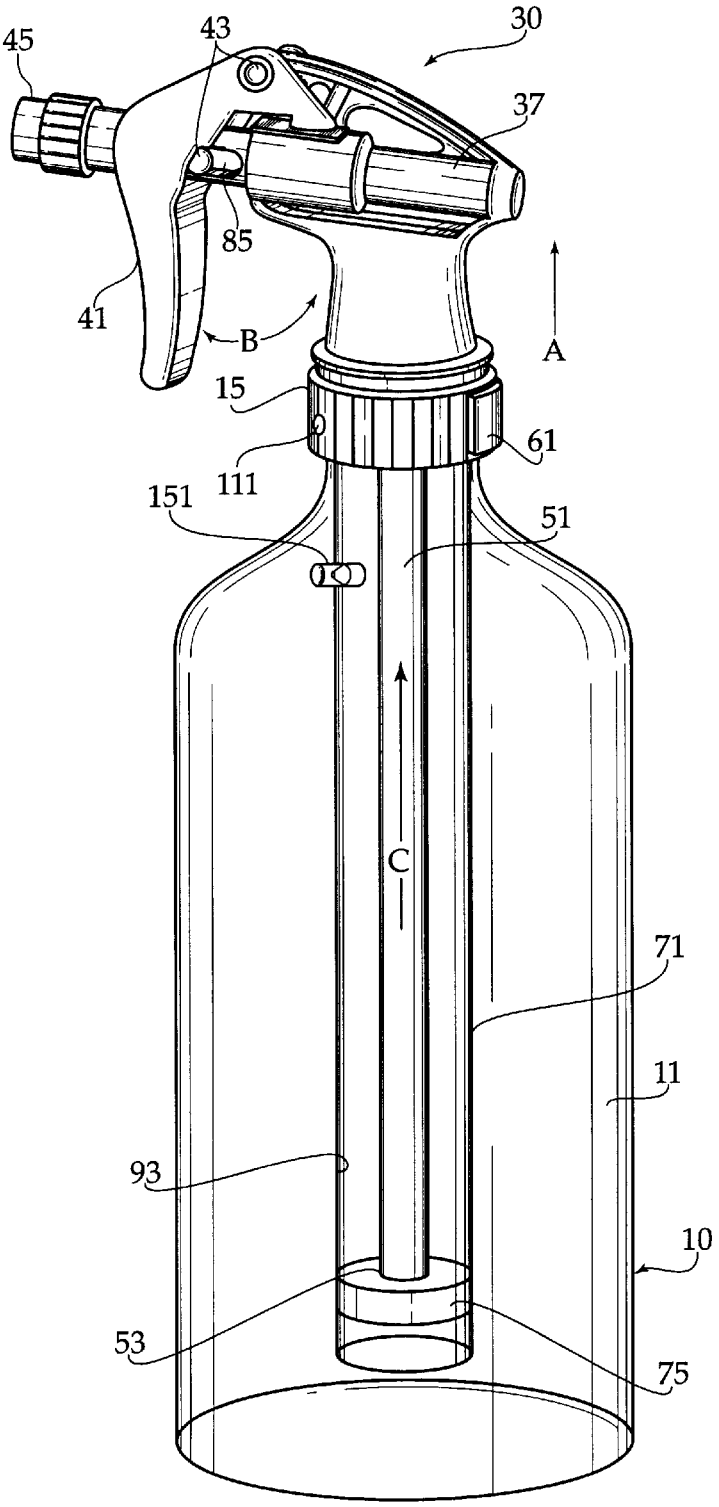
FIG. 1 is a diagrammatic perspective view of the pump actuated fluid dispenser mounted on top of a container, in accordance with the present invention.

FIG. 1 shows a pump actuated fluid dispenser 30 mounted on a container 10 that has a container interior 11. According to the invention, the fluid dispenser 30 comprises a main body 37 and a trigger 41. The trigger 41 is used for actuating the fluid dispenser 30, wherein fluids are selectively dispersed in a sporadic or a continuous fluid spray from within the container 10.

Figure 2:
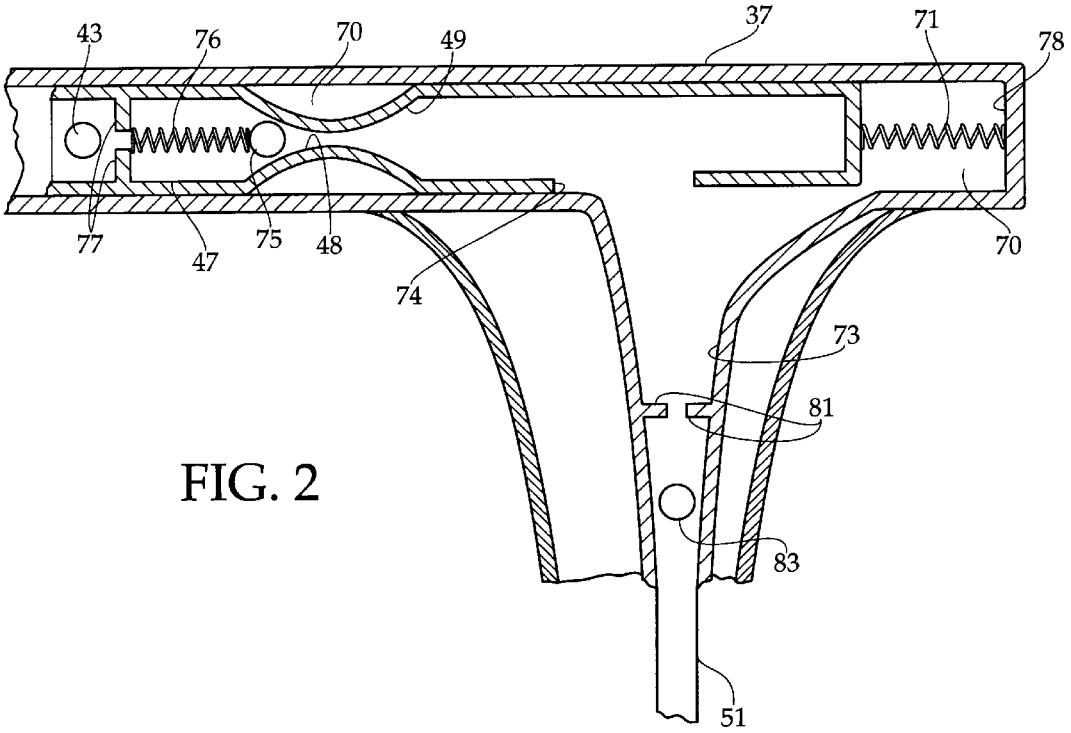
FIG. 2 is a partial sectional view of the spray mechanism of the fluid dispenser.

The main body 37 is fitted on top of a cap 15 that is securely screwed onto the top of the container 10. Referring briefly to FIG. 2, the main body has an interior chamber 70 that securely houses a plunger shaft 47 therein. The plunger shaft 47 is capable of moving in and out from the interior chamber 70 of the main body 37.

A bottom neck 73 is provided in the main body 37, which extends into the container interior 11. The fluid dispenser 30 has a tube 51 that is mounted to the bottom neck 73 within the container interior 11, such that the tube extends downwardly into the container interior 11. As shown in FIG. 1, the tube 51 is open to the container interior 11 providing passage to the liquid from the container 10 to the plunger shaft 47 (FIG. 2) within the main body 37, in the direction of arrow C.

Figure 3:
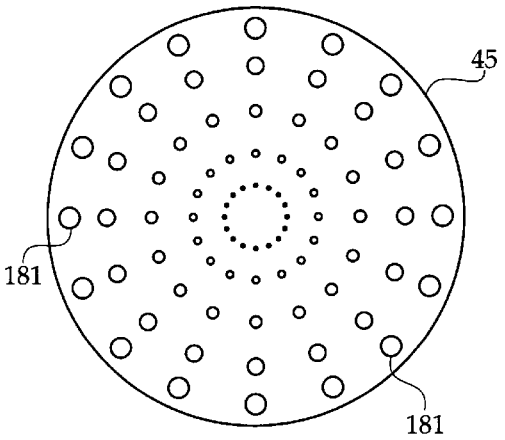
FIG. 3 provides a front elevational view of the nozzle.

The main body 37 has a front portion, which has a nozzle 45 attached thereto. As shown in FIG. 3, the nozzle 45 has a plurality of pores 181 to allow dispensement of liquids in a mist-like fashion.

As shown in FIG. 1, the trigger 41 is pivotably mounted to the main body 37 and to the plunger shaft 47 by a pair of screws 43, which allows the trigger 41 to move toward and away from the main body 37 in the direction of arrow B. When the trigger 41 is squeezed, the plunger shaft 47 is pushed inward into the interior chamber 70 of the main body 37. A slit 85 is provided on the main body 37 to allow the trigger 41 to pivot and move the plunger shaft 47 into the interior chamber 70. The slit 85 allows the screw 43 on the plunger shaft 47 to slide back and forth as the trigger 41 is selectively squeezed and released.

The interior chamber 70 has a back wall 78, which has a rear spring 71 mounted thereon for pushing the plunger shaft 47 forward. As a result, when the trigger 41 is no longer being squeezed, the plunger shaft 47 is pushed forward within the chamber 70 by the rear spring 71, which also returns the trigger 41 to its normal position away from the main body 37.

As shown in FIG. 2, the plunger shaft 47 has a hollow compartment 49 that stores liquids as they pass from within the container interior 11 to the nozzle 45 from which the liquids are dispensed. The plunger shaft 47 has a bottom opening 74 that allows passage of fluids from the container interior 11 to the hollow compartment 49.

The plunger shaft 47 has a front portion, which is provided with a pair of stoppers 77, and a stopper ball 75 that is spring mounted to the stoppers 77 by a lightly-tensioned spring 76. The lightly-tensioned spring 76 pushes the ball 75 towards a narrow aperture 48 within the hollow compartment 49, such that the narrow aperture 48 is closed when no fluid is being dispersed. However, when fluids move from within the hollow compartment 49 to the nozzle 45, the stopper ball 75 is pushed forward and away from the narrow aperture 48, which creates an opening for allowing fluids to pass therethrough.

The bottom neck 73 in the main body 37 has a pair of bottle stoppers 81 and a pellet 83. According to the invention, the pellet 83 blocks access to the tube 51 when no liquid is being dispensed by preventing any liquid in the plunger shaft 47 from dripping back into the container 10, which ensures that the contents in the container's interior 11 remain pressurized. It is envisioned that when the trigger 41 is squeezed, the pressure in the container's interior 11 forces the liquid out of the container 10 through the bottom neck 73 and into the hollow compartment 49 of the plunger shaft 47.

The fluid dispenser 30 has a plurality of locking mechanisms 61 that securely hold the main body 37 on top of the cap 15. The main body 37 may be released from the cap 15 by disengaging the locking mechanisms 61 and pulling the main body 37 away from the container 10 in the direction of arrow A, as shown in FIG. 1.

It is possible to dispense fluids from the container 10 for longer periods by manual pumping, which pressurizes the liquid within the container 10. The fluid dispenser 30 has a pumping cylinder 71 that extends vertically downward from the cap 15 into the container interior 11. The cylinder 71 has an interior portion 93, which houses the tube 51 therein.

The tube 51 has a bottom portion 53, which is securely mounted with a donut-shaped rubber washer 75. The cylinder 71 is kept air-tight by mounting the washer 75 on the tube 51 such that the washer 75 is parallel to the bottom opening of pumping cylinder 71 and blocks access to the interior portion 93.

The cylinder has a top portion near the cap 15, which is provided with a one-way valve 151. The one-way valve 151 allows air to pass from the pumping cylinder 71 to the container 10, while preventing the container's contents from entering into the interior portion 93 of the pumping cylinder 71.

According to the invention, to obtain a continuous dispensement of fluids from the container interior 11, the main body 37 is removed from the cap 15 and pulled upward in direction of arrow A. As the main body 37 moves away from the cap 15, the washer 75 mounted on the tube 51 moves upward within the interior portion 93 of the pumping cylinder 71. According to the invention, the upward movement of the washer 75 ejects all air from the interior portion 93 of the cylinder 71 into the container 10 through the one-way valve 151, which pressurizes the contents in the container interior 11.

When the washer 75 is near the cap 15 at the top portion of the cylinder 71, the main body 37 is pushed back downward, which causes the washer 75 to move downward in the interior portion 93 of the pumping cylinder 71. The cap 15 has a one way valve 111 that lets air into the interior 93 when the washer 75 is pushed down. When the washer 75 is pulled upward, air in the interior 93 is forced out of the one way valve 151 into the container interior 11.

With every cycle of pushing the washer 75 into the container 10 and then pulling it upward, a fixed amount of pressure is generated in the container interior 11. After the container interior 11 has been adequately pressurized, the user may dispense the fluids stored therein by simply squeezing the trigger 41. Dispensement of fluids continues as long as the trigger 41 is maintained squeezed and as long as the container's interior 11 is adequately pressurized.

Many specific details contained in the above description merely illustrate some preferred embodiments and should not be construed as a limitation on the scope of the invention. Accordingly, many other variations are possible within the spirit of the present invention, limited only by the scope of the appended claims.

What is claimed is:

1. A pump actuated fluid dispenser for selectively allowing a sporadic or continuous fluid dispensement from within a container interior, comprising:

a cap;

a main body having a front portion, said main body mounted on said cap;

a plunger shaft mounted within the main body, wherein said plunger shaft moves inward and outward from said front portion of said main body;

a trigger mounted to said main body and said plunger shaft, such that squeezing the trigger pushes said plunger shaft into the main body;

a pumping cylinder extending downward from said cap, said pumping cylinder having an interior portion;

a tube extending downward from said main body within the interior portion of said cylinder, said tube having an opening towards its bottom portion for allowing fluids to flow therethrough from within the container's interior;

a washer securely mounted on said tube within the interior portion of said cylinder, wherein said washer blocks access to the interior portion of said pumping cylinder from within the container interior; and a one-way valve on the cylinder for allowing passage of air from within the pumping cylinder to the container interior.

2. The pump actuated fluid dispenser of claim 1, wherein said main body has an interior chamber which securely houses said plunger shaft therein.

3. The pump actuated fluid dispenser of claim 2, wherein said interior chamber has a back wall, said back wall mounted with a rear spring that pushes the plunger shaft away from the back wall and toward the front portion of said main body.

4. The pump actuated fluid dispenser of claim 3, wherein said pumping cylinder has a top portion near said cap and wherein said one-way valve is located near said top portion of the pumping cylinder.

5. The pump actuated fluid dispenser of claim 4, wherein said cap is provided with a one-way valve.

6. The pump actuated fluid dispenser of claim 5, wherein said plunger shaft comprises:

a hollow compartment having a front portion, said compartment comprising a narrow aperture towards the front portion, said plunger shaft having an opening for allowing fluids into said hollow compartment from within the container;

a pair of stoppers near the front end of the hollow compartment; and a stopper ball near the narrow aperture towards the front portion, said stopper ball attached to said pair of stoppers by a spring.

7. The pump actuated fluid dispenser of claim 6, wherein the front portion of said main body has a nozzle mounted thereon.

8. The pump actuated fluid dispenser of claim 7, further comprising a locking mechanism for securely attaching the main body to said cap.

9. The pump actuated fluid dispenser of claim 8, wherein said nozzle is provided with a plurality of pores to dispense liquid in a mist.

* * * * *